US006523293B2

(12) United States Patent
Murello et al.

(10) Patent No.: US 6,523,293 B2
(45) Date of Patent: Feb. 25, 2003

(54) ARRANGEMENT FOR OPENING THE DUST FLAP OF A FIREARM

(75) Inventors: Johannes Murello, Deisslingen (DE); Helmut Weldle, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/916,911

(22) Filed: Jul. 27, 2001

(65) Prior Publication Data

US 2002/0073592 A1 Jun. 20, 2002

Related U.S. Application Data

(63) Continuation of application No. PCT/EP00/00520, filed on Jan. 24, 2000, which is a continuation of application No. PCT/EP00/00551, filed on Jan. 25, 2000.

(30) Foreign Application Priority Data

Jan. 28, 1999 (DE) ..... 199 03 326
Jan. 28, 1999 (DE) ..... 199 03 327

(51) Int. Cl.[7] ..... F41A 15/00
(52) U.S. Cl. ..... 42/25; 42/98
(58) Field of Search ..... 42/25, 98, 106; 89/33.4

(56) References Cited

U.S. PATENT DOCUMENTS 2,967,367 A * 1/1961 Ivy ..... 42/16
3,807,075 A * 4/1974 Mylonas ..... 42/98
3,882,625 A 5/1975 Iellie ..... 42/25
3,999,318 A * 12/1976 Tellie ..... 42/106
4,562,659 A * 1/1986 Neta ..... 42/71.01
4,691,615 A * 9/1987 Brunton ..... 89/33.4
5,285,593 A * 2/1994 Bammate ..... 42/98
6,314,672 B2 * 11/2001 Murello et al. ..... 42/124

FOREIGN PATENT DOCUMENTS

CH 580 269 9/1976
DE 501266 C 7/1930
DE 2 402 445 8/1974

OTHER PUBLICATIONS

International Search Report corresponding to International Patent Application Ser. No. PCT/EP00/00520, dated May 26, 2000, 3 pages.
International Preliminary Examination Report corresponding to International Patent Application Ser. No. PCT/EP00/00520, dated Aug. 13, 2001, 5 pages.

* cited by examiner

*Primary Examiner*—Charles T. Jordan
*Assistant Examiner*—Michelle Thomson
(74) *Attorney, Agent, or Firm*—Marshall, Gerstein & Borun

(57) ABSTRACT

An apparatus is provided for use in a firearm having a housing defining a first ejection opening and a second ejection opening. The apparatus includes first and second dust flaps mounted adjacent the first ejection opening for movement between an opened position and a closed position. The apparatus also includes a bolt assembly adapted to be selectively mounted in a first assembly position and a second assembly position for longitudinal movement within the housing. When the bolt assembly is in the first assembly position, a longitudinal movement of the bolt assembly moves the first dust flap to the opened position and, when the bolt assembly is in the second assembly position, the longitudinal movement of the bolt assembly moves the second dust flap to the opened position.

15 Claims, 3 Drawing Sheets

ARRANGEMENT FOR OPENING THE DUST FLAP OF A FIREARM

RELATED APPLICATIONS

This patent claims priority under 35 U.S.C. §120 from International Application No. PCT/EP00/00520, which was filed on Jan. 24, 2000, from International Application No. PCT/EP00/00551, which was filed Jan. 25, 2000, and from U.S. application Ser. No. 09/911,008 filed Jul. 23, 2001.

FIELD OF THE INVENTION

The invention relates generally to firearms, and, more particularly, to an arrangement for opening the dust flap of a firearm.

BACKGROUND OF THE INVENTION

The position terms used in this patent, like "front", "back", "top", "bottom" or the like always assume a weapon in the normal firing position; (i.e., a weapon position in which the center axis of the barrel of the weapon runs generally horizontally and the direction of firing points "forward" away from the shooter). The same convention applies for the direction statements used herein ("to the front", "upward", "leftward", etc.).

The cartridge casings in automatic firearms are generally ejected through an ejection opening on the weapon housing after the firing process. To prevent contaminants, like sand, etc., from reaching the interior of the weapon through the ejection opening, the ejection opening is often closed by a cover which is only opened for casing ejection. An example of this approach is the British SA-80 rifle, in which the shooter can manually close the ejection opening by means of a flap. The flap is automatically opened during shooting as soon as the first casing is ejected.

A mechanism to open such a protective flap is known from DE-PS 501 266. The protective flap is mounted to rotate adjacent the ejection opening and is loaded by a torsion spring, which seeks to pivot the protective flap into its opened position. In the closed state, the protective flap snaps onto the weapon housing via a claw, so that it is secured in its closed position against the force of the spring. The bolt assembly has an elevation on one side that engages beneath the claw of the protective flap during movement of the bolt assembly, (for example, during shooting). This engagement with the bolt assembly lifts the claw from its locked position. The protective flap then springs open under the load of the spring to expose the ejection opening for casing ejection.

The automatic firearms now in use generally have a bolt assembly that is arranged to move in the longitudinal direction of the weapon. After firing of a cartridge, casing ejection occurs. This ejection is affected when the bolt assembly travels rearward and a claw-like extractor on the bolt assembly surface pulls the empty cartridge casing from the barrel. The bottom of the cartridge casing then strikes against a protrusion fixed on the housing, so that the cartridge is tilted laterally and ejected through the ejection opening.

The ejection process just described can also be produced manually by the shooter. This manual ejection is necessary, for example, when a cartridge does not fire during the shooting process and is not automatically ejected. The shooter must then reload by hand, whereupon the still live cartridge is ejected. The term cartridge casing, as used herein, therefore does not refer merely to spent casings, but also to the casings of live cartridges.

Present day semiautomatic weapons and submachine guns are generally designed only for right-hand use. In these weapons the casings are ejected on the right side during firing. Therefore, a left-handed shooter who fires the weapon from the left shoulder, faces the hazard of being struck on the right arm by the ejected cartridge casings. This hazard represents a significant burden for the shooter and makes left-handed use of such a weapon problematical.

In small arms of the so-called bullpup design, the magazine and bolt assembly are positioned behind (instead of in front of) the trigger. The casing ejector arranged above the magazine is, therefore, situated next to, or right in front of, the face when the weapon is aimed. Ejected casings in a right-handed weapon would fly directly against the head or into the face of a left-handed shooter. Therefore, firing with the left hand is extremely hazardous, if not impossible, in a bullpup-type weapon that ejects to the right since the shooter cannot properly aim the weapon, but, instead, is forced to keep the weapon forward, away from the body.

It is known that firing safety and safe handling of weapons among left-handed shooters could be improved if weapons for left-handed use were made available. As a result, there are also weapons (like the French assault rifle FAMAS), in which casing ejection can be alternately set up to the right or the left. The extractor claw in this rifle can alternately be mounted on either of two sites on the bolt assembly surface, so that the spent casings are ejected either to the right or to the left, as desired. Another example is the Austrian Steyr AUG (army universal rifle), in which, as in the FAMAS, the extractor claw can be mounted on either side of the weapon.

Another patent of the current assignee of this patent entitled "Bolt Mechanism for a Firearm" (U.S. application Ser. No. 09/911,008 which is hereby incorporated herein by reference) also describes possibilities of simplifying conversion of casing ejection between right and left ejection. For this purpose, the bolt assembly or its bolt head is designed so that it can alternately be positioned in either of two positions, and/or an ejector is integrated in the bolt mechanism that removes the cartridge casing from the bolt assembly after extraction from the barrel.

The aforementioned FAMAS and Steyr AUG rifles have ejection openings on both sides of the weapon housing so that, depending on how casing ejection is set up, the cartridge casings fly out through the left or right openings. The unused opening is covered by a cheek protector or plastic plug.

A semiautomatic rifle with adjustable casing ejection and two ejection openings is also known from CH 580 269, in which the unused opening can be firmly closed by a cover. During conversion of casing ejection, the cover (which fits both openings) is switched by hand to the opening not being used for ejection.

This type of arrangement has the drawback that the employed ejection opening is always open, so that contaminants can easily penetrate into the weapon housing and cause functional disorders. It is also a drawback that such a cover must be switched by hand after conversion of casing ejection. If the shooter forgets to switch the cover, there is a hazard that the spent casing will not be ejected, but will instead strike the incorrectly positioned cover. This mishap would immediately result in jamming and possibly also damage to the bolt assembly.

A device for pivotable side ejection for weapons is also known from DE-OS 2 402 445.

SUMMARY OF THE INVENTION

In accordance with an aspect of the invention, an apparatus is provided for use in a firearm having a housing defining a first ejection opening and a second ejection opening. The apparatus includes a first dust flap mounted adjacent the first ejection opening for movement between an opened position and a closed position. The apparatus also includes a second dust flap mounted adjacent the second ejection opening for movement between an opened position and a closed position. The apparatus also includes a bolt assembly adapted to be selectively mounted in a first assembly position and a second assembly position for longitudinal movement within the housing. Additionally, the apparatus includes an ejection device coupled to the bolt assembly for ejecting cartridge casings through the first ejection opening when the bolt assembly is in the first assembly position and for ejecting cartridge casings through the second ejection opening when the bolt assembly is in the second assembly position. When the bolt assembly is in the first assembly position, a longitudinal movement of the bolt assembly moves the first dust flap to the opened position and, when the bolt assembly is in the second assembly position, the longitudinal movement of the bolt assembly moves the second dust flap to the opened position.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
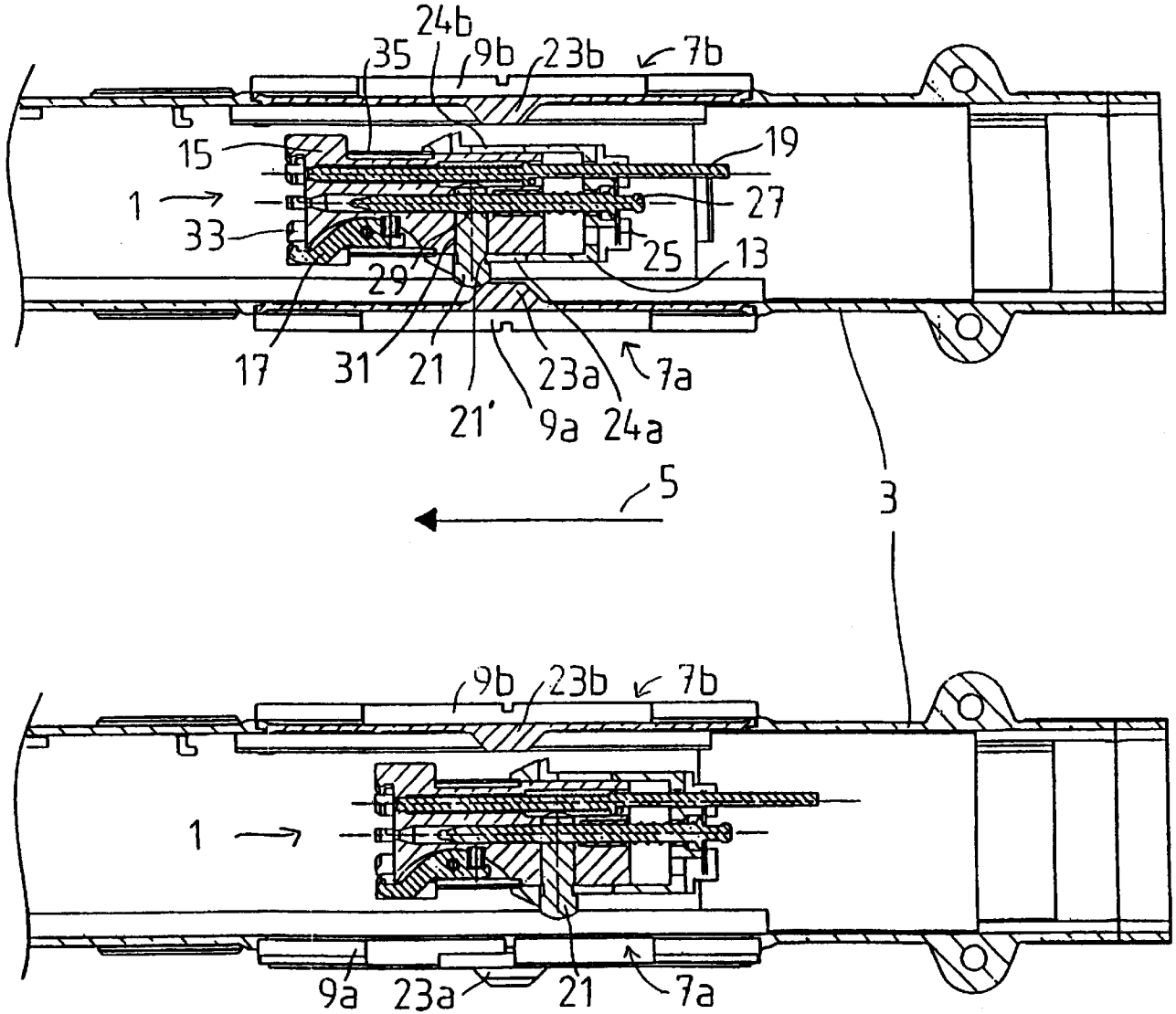
FIG. 1*a* is a top sectional illustration of a bolt assembly and dust flap arrangement constructed in accordance with the teachings of the instant invention.
FIG. 1*b* is a view similar to FIG. 1*a,* but showing the bolt assembly farther back and the left dust flap open.

FIG. 1*a* shows a bolt assembly 1 which is arranged in a weapon housing 3 for movement in the longitudinal direction of the firearm (indicated by arrow 5, which points forward in the direction of shooting). An ejection opening 7*a,* 7*b* is situated on each side of the weapon housing 3. Each opening 7*a,* 7*b* is respectively closed by a dust flap 9*a,* 9*b*. The dust flaps 9*a,* 9*b* are snapped onto the weapon housing 3 and loaded by a spring (not shown here) in the direction of the opening (i.e., toward the center of the housing 3). The spring may be, for example, a torsion spring. The bolt assembly 1 is assembled from a bolt carrier 13 and a bolt head 15. An ejection device, which comprises an extractor claw 17 and an ejector 19, is integrated in the bolt head 15. A pin 21 is mounted on the bolt assembly 1 and protrudes from its left side.

During return travel of the bolt assembly 1, the pin 21 strikes against a tab 23*a* of the dust flap 9*a*. The dust flap 9*a* is abruptly pushed open by the momentum of pin 21 and the ejection opening 7*a* is exposed for casing ejection. The extractor claw 17 and ejector 19 are arranged so that they eject the cartridge casings to the left (through ejection opening 7*a* (as explained in U.S. application Ser. No. 09/911,008). The force of the aforementioned spring flips the dust flap 9*a* downward by about 180° (if this has not already occurred by virtue of the momentum of pin 21) so that the outside of the dust flap 9*a* lies against the exterior of the weapon housing 3, as shown in FIG. 1*b*. The dust flap 9*a* is held in this position by the spring until the dust flap 9*a* is manually reclosed by the shooter.

Figure 2:
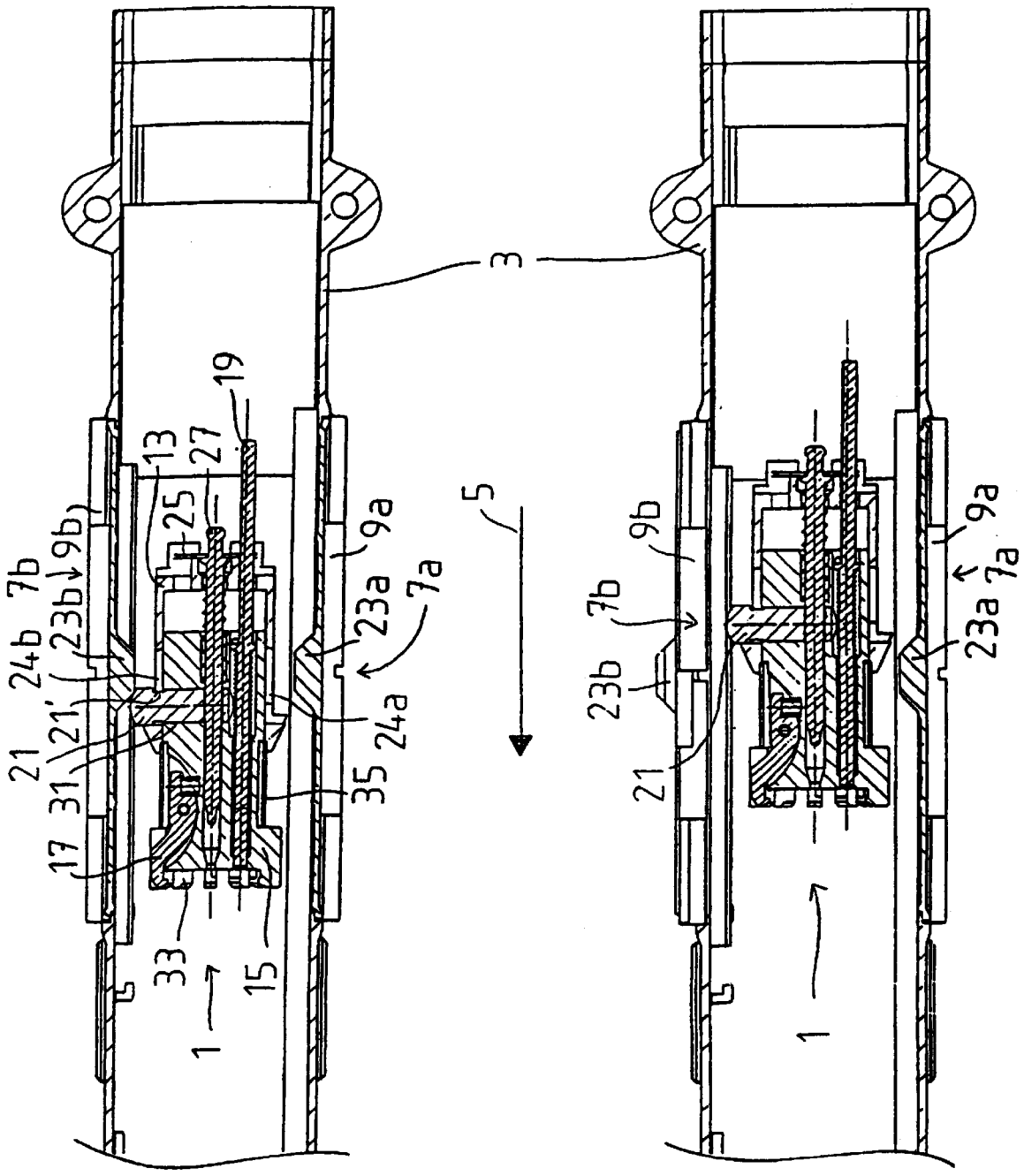
FIG. 2*a* is a view similar to FIG. 1*a,* but showing the bolt assembly positioned in an alternative assembly position.
FIG. 2*b* is a view similar to FIG. 2*a,* but showing the bolt assembly farther back and the right dust flap open.

FIG. 2*a* shows the arrangement from FIG. 1*a* with the bolt head 15 in its second assembly position. When in this second position, the bolt assembly is rotated by about 180° in the peripheral direction (in comparison with FIG. 1). As a result, the free end of the pin 21 protrudes on the right side so that, during return travel of the bolt assembly 1, the pin 21 now strikes against a tab 23*b* of the right dust flap 9*b* and opens it, as shown in FIG. 2*b*. The positions of the extractor claw 17 and the ejector 19 are also reversed when the bolt head is in its second assembly position as explained in U.S. application Ser. No. 09/911,008. As a result, casing ejection occurs to the right through ejection opening 7*b* when the bolt assembly is assembled as shown in FIG. 2.

By converting the bolt head 15 between the assembly positions depicted in FIGS. 1 and 2, the dust flap opening activated for casing ejection is simultaneously converted from left to right and vice versa. In addition to the advantage of shortening the time required for weapon conversion, this approach guarantees that the correct dust flap 9*a,* 9*b,* (i.e., the one lying in the ejection direction of the cartridge casing), is always opened.

Conversion of the bolt head 15 from one assembly position to the other occurs as follows. The pin 21 which, in the assembled state, passes through a slot 24*a* or 24*b* of the bolt carrier 13 and, thus, keeps the bolt head 15 in its position is first removed. For this purpose, a retaining plate 25 is removed and a firing pin 27 pulled from a retaining hole 29 of the pin 21 as explained in U.S. application Ser. No. 09/911,008. The pin 21 is then pulled from a transverse hole 31. The bolt head 15, together with the extractor claw 17 and ejector 19, can then be removed from the bolt carrier 13, rotated, and inserted back into the bolt carrier 13 in the opposite assembly position. The pin 21 is then pushed back into transverse hole 31 (preferably through the opposite one of slot 24*a*or 24*b*) and secured by the firing pin 27. Finally, the retaining plate 25 is re-positioned.

Locking and unlocking of the bolt assembly 1 occurs via a slot guide by means of slots 24*a,* 24*b* and pin 21. The pin 21 has a countersinking 21' into which the edge of slot 24*a* or 24*b* engages. The countersinking 21' serves to lengthen the locking path, but is not necessary.

In a firearm ready to fire, the bolt assembly 1 is locked, (i.e., locking projections 33 of the bolt head 15 engage behind a matching counterpiece (e.g., defined by pins or bores) which is connected rigidly to the cartridge chamber (not shown here). The pin 21 is then situated on the rear end of slot 24*a* or 24*b*. After firing of the cartridge (or during manual reloading), the bolt carrier 13 initially moves rearward. Pin 21 then follows the arc-shaped trend of slots 24*a,* 24*b* as explained in U.S. application Ser. No. 09/911,008 thereby forcing the bolt head 15 to rotate, so that the bolt assembly 1 unlocks. Finally, the pin 21 reaches the front end of slot 24*a* or 24*b* (e.g., the position shown in FIGS. 1 or 2) and is entrained rearward by the bolt carrier 13. In this manner, the bolt head 15 is first rotated in the peripheral direction by the movement of the bolt carrier 13, and then moved rearward. A sleeve 35 prevents the bolt head 15 from being rotated unintentionally during return and forward travel after unlocking of the bolt assembly 1. The sleeve 35 is compressed for locking so that the bolt head 15 can be rotated again by the slot guide.

Pin 21 is thus, used both for opening the dust flap 9*a,* 9*b,* and for forming part of the slot guide. The pin 21, therefore, fulfills an advantageous dual function. This dual function approach reduces the design expense and simultaneously facilitates maintenance and care of the bolt assembly 1.

Figure 3:
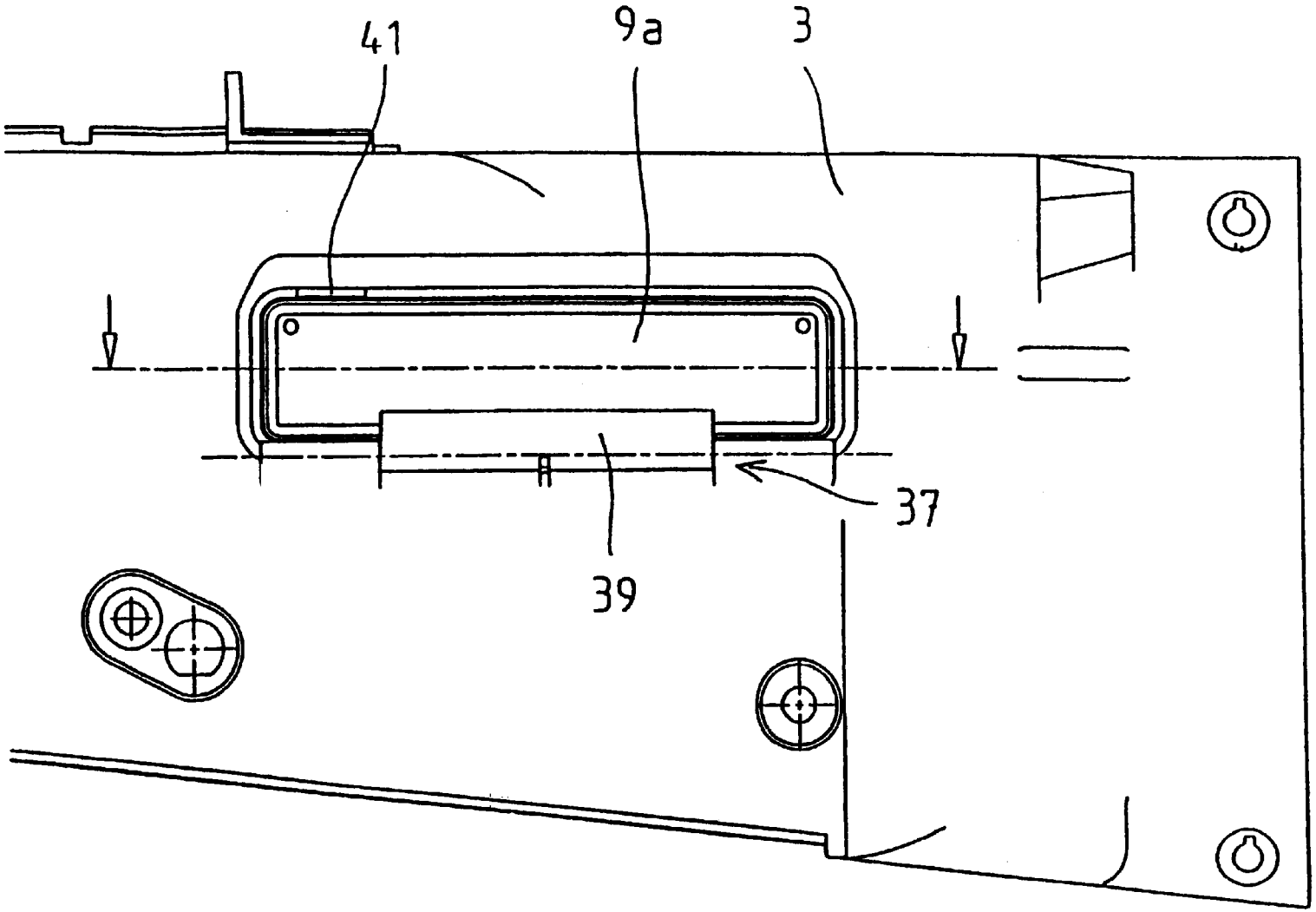
FIG. 3 is a left side view of the left dust flap from FIGS. 1 and 2 shown in the closed state.

FIG. 3 shows a left side view of the left dust flap 9*a* in the closed state. The dust flap 9*a* is mounted behind an aperture 39 of the weapon housing 3 via a hinge-like mount 37. A nipple 41 on the dust flap 9*a* is snapped into the inside of the weapon housing 3 and prevents the dust flap 9*a* from being opened downward by the spring tension of mount 37. In this manner, the dust flap 9*a* remains closed until nipple 41 has been pushed from its locking engagement with the weapon housing 3 by the momentum of the pin 21 striking against tab 23*a* of dust flap 9*a.*

The dust flap 9*b* on the right side of weapon housing 3 is mounted in the same manner as dust flap 9*a* (not shown here).

From the foregoing persons of ordinary skill in the art will appreciate that a firearm has been disclosed which includes a convertible direction of casing ejection feature wherein the weapon is better protected against dust. In particular, the firearm includes: (a) a bolt assembly 1 which is mounted for longitudinal movement in a weapon housing 3 of the firearm and which can be mounted alternately in at least two assembly positions in the firearm, (b) an ejection device 19 coupled to the bolt assembly 1 which ejects the cartridge casings in the direction of one or the other side of the firearm from ejection openings 7*a,* 7*b* in the weapon housing depending upon the assembly position of the bolt assembly 1, (c) dust flaps 9*a,* 9*b* moveably mounted in the ejection openings 7*a,* 7*b* which permit unhampered emergence of the cartridge casings from the ejection openings 7*a,* 7*b* in the opened state, whereas, in the closed state, the flaps 9*a,* 9*b* close the ejection openings 7*a,* 7*b.* The bolt assembly 1 serves as means for automatically opening the dust flaps 9*a,* 9*b* and is designed so that it only opens the dust flap 9*a,* 9*b* lying in the ejection direction of the cartridge casings during its reloading movement, owing to its corresponding assembly position.

When the weapon is not in use, all ejection openings 7*a,* 7*b* can, therefore, be closed by the applied dust flaps 9*a,* 9*b,* so that entry of dirt into the interior of the weapon is effectively prevented. The disclosed apparatus, therefore, succeeds in retaining the advantages of dust flap arrangements known in the prior art and transferring them to firearms with convertible casing ejection.

The term ejection device comprises all known devices that are suitable for removing a cartridge casing situated in the barrel from the weapon, (e.g., the combination of an extractor claw and a protrusion fixed on the housing described in the introduction). By way of example, not limitation, the term at least includes the combination of an extractor and an integrated ejector, as described in the co-pending patent of the applicant (U.S. application Ser. No. 09/911,008.

As is known, the bolt assembly 1 is often assembled from a bolt carrier 13 and a bolt head 15. "Assembly positions of the bolt assembly" are, therefore, understood to mean, any of: (1) the assembly positions of the entire bolt assembly, and (2) the assembly positions of an individual portion of the bolt assembly, such as the bolt carrier or bolt head.

For opening of the dust flaps 9*a,* 9*b,* the bolt assembly 1 or bolt head 15 has a protrusion which strikes the dust flap (9*a,* 9*b*) lying in the ejection direction of the casing during return of the bolt assembly 1 or bolt head 15 after a shot is fired. To facilitate this process, the dust flaps 9*a,* 9*b* have inwardly directed tabs 23*a,* 23*b,* against which the protrusion moves during the aforementioned return travel.

There are many different possibilities for varying the position of the protrusion so that a different dust flap is opened.

Several assembly positions are prescribed for the protrusion on the bolt assembly 1 or bolt head 15. The connection between protrusion and bolt assembly 1 or bolt head 15 is releasable, so that the protrusion can be moved from one assembly position to another in the disassembled bolt assembly 1 or bolt head 15. This advantageously occurs with conversion of casing ejection from the right mode to the left mode and vice versa. Disassembly of the bolt assembly 1 or bolt head 15 is generally also required for this conversion, so that movement of the protrusion and conversion of the casing ejection mode (for example, by moving the extractor claw) can occur in one working step.

It is also conceivable to provide the bolt assembly 1 or bolt head 15 with several protrusions that can only strike the dust flap on passing by it if an inward directed tab is mounted on them. Because of this, which dust flap is to be opened or remain closed during return of the bolt assembly can be set by mounting and removing the tab(s).

Several interchangeable bolt assemblies or bolt heads are possible in which the protrusion is situated at a different site on each bolt assembly or bolt head. This is particularly advantageous when conversion of casing ejection also occurs by replacing the bolt assembly or bolt head with a different bolt assembly or bolt head. In a preferred embodiment, one bolt assembly or bolt head is available for right ejection and one bolt assembly or bolt head is available for left ejection. Preferably, the ejection device or at least the extractor is integrated in the bolt assembly or bolt head. A protrusion is then mounted on each bolt assembly or bolt head so that it opens the dust flap lying in the desired direction of ejection.

The bolt assembly or bolt head can be converted between several assembly positions so that the protrusion is simultaneously moved, if desired. Here again, it is particularly advantageous if the ejection device or at least the extractor 19 is integrated in the bolt assembly 1 or bolt head 15 such that the direction of casing ejection is changed by changing the position of the bolt assembly 1 or bolt head 15.

The last two solutions have the advantage that conversion of the direction of casing ejection and corresponding movement of the protrusion can occur in one process by integration of the ejection device, or at least the extractor, in the bolt assembly or bolt head. Both occur simultaneously and automatically with replacement or conversion of the bolt assembly or bolt head. Therefore, it is also ensured that the "correct" dust flap is always opened (i.e., the one that lies in the desired direction of ejection of the casings). A casing jam in the weapon interior due to an incorrectly blocked ejection opening (by the dust flap) is reliably prevented by this approach.

In addition to these advantages, the latter is given additional preference in that no replacement components are necessary for it (but these can naturally be provided, if desired).

In another example, a pin 21 is mounted on the bolt assembly 1 or bolt head 15. The pin 21 protrudes far enough on one side so that it forms the protrusion with its free end. In order to mount the pin 21 on the bolt assembly 1 or bolt head 15, the latter has a transverse hole in to which the pin 21 can be introduced. The pin 21 preferably has a retaining hole that is traversed by the firing pin which is guided through the bolt assembly 1 or bolt head 15 in the longitudinal direction. During assembly, the pin 21 is, therefore, first inserted into the transverse hole, and then the firing pin is guided through the retaining hole. The pin 21 is, therefore, held in position by the firing pin. In a bolt assembly or bolt head with an integrated ejector, it is also possible to secure the pin 21 by the ejector, in which case the ejector (instead of the firing pin) passes through the pin 21.

The bolt assembly 1 is preferably designed from a bolt carrier 13 and a bolt head 15. In this manner, the entire bolt assembly 1 need not be converted (or replaced), but only one of the two parts, preferably the bolt head 15. In a particularly advantageous approach, the bolt carrier 13 is a roughly can-shaped hollow element, into which the bolt head 15 can be introduced. Conversion (or replacement) of the bolt head 15 is possible in simple fashion. In a preferred embodiment, the bolt carrier 13 and bolt head 15 are designed so that the bolt head 15 is rotatable within the bolt carrier 13 around its center axis running in the longitudinal direction of the weapon. The assembly position of the bolt head 15 is freely selectable on this account.

Because of the design of the protrusion as a pin 21 just described, it is readily possible to mount it subsequently, (i.e., after the bolt head 15 has been introduced to the bolt carrier 13). The pin 21 is introduced into the transverse hole from the outside through an opening of the bolt carrier 13. The bolt head 15 can thus be anchored in simple fashion in the bolt carrier 13. A corresponding number of openings are then provided on the bolt carrier 13 for different incorporation positions of the bolt head 15.

Preferably, the bolt carrier 13 has at least one substantially arc-shaped elongated hole into which the pin 21 of the bolt head 15 can be introduced. In the assembled state, the pin 21 passes through the elongated hole in the transverse direction and protrudes with its free end preferably above the bolt carrier 13. The pin 21 is movably mounted within the elongated hole so that it can follow the arc-shaped curve when the bolt carrier 13 and bolt head 15 are pushed against each other. The elongated hole is preferably designed so that the bolt head 15 is guided by the pin 21 during forward and return travel of the bolt assembly 1 or bolt carrier 13 such that the bolt head 15 is initially rotated in the peripheral direction and only then follows the movements of the bolt carrier 13. Rotation of the bolt head 15 then serves for locking and unlocking of the bolt assembly 1.

This functions as follows: during forward travel of the bolt assembly 1, a new cartridge is fed from the magazine and pushed by the bolt head 15 into the cartridge chamber (i.e., the part of the barrel that accommodates the cartridge). The bolt head 15 then lies on the cartridge chamber or cartridge bottom and remains there, while the bolt assembly 1 or bolt carrier 13 travels farther forward. The bolt carrier 13 and bolt head 15 are pushed in this manner against each other and the pin 21 then travels within the arc-shaped elongated hole, (hereafter called a slot), from the front to the rear. The pin 21 is then pushed in the peripheral direction of the bolt assembly 1, so that the bolt head 15 is rotated accordingly. Because of this rotation, the bolt assembly 1 is locked, (i.e., rearward movement of the bolt head is blocked). This locking is caused by the fact that locking protrusions on the bolt head 15 engage in a matching counterpiece on the cartridge chamber by rotation. After firing of the cartridge, the bolt assembly 1 or bolt carrier 13 travels back thereby rotating the bolt head 15 in the described manner in the peripheral direction, but this time in the opposite direction, so that the bolt assembly 1 is unlocked again. Finally, the pin reaches the front end of the slot and is entrained rearward by the bolt assembly 1 (and the bolt head 15 with it). Because of the time-delayed opening of the cartridge chamber, it is guaranteed that the bolt assembly 1 remains closed long enough for the projectile to leave the barrel and for the gas pressure to diminish.

As stated above, the position of the protrusion is preferably changed by moving the bolt head 15 from one assembly position to another. The bolt carrier 13 has at least two arc-shaped elongated holes or slots for this purpose into which the pin 21 of the bolt head 15 can be introduced. In a preferred embodiment, the bolt carrier 13 has slots on the left and right sides, which are arranged so that they are diametrically opposite each other. In the assembled state, the pin 21 only passes through one of the two slots. However, it is also possible to design the pin and mount it in the bolt carrier 13 so that it simultaneously passes through both slots (but preferably only protrudes on one side of the bolt carrier 13).

In the normal case, the cartridge casings are ejected on the left or right side of the weapon. The weapon housing, therefore, preferably has an ejection opening on each side. There openings are preferably arranged substantially opposite each other.

In a preferred embodiment, the dust flaps 9*a,* 9*b* are arranged on the outside of the weapon housing and can be flipped outward from it, (for example, via a hinge). It is advantageous if the dust flaps 9*a,* 9*b* as described above have inwardly directed tabs, since the dust flaps 9*a,* 9*b* can then be struck more easily by the protrusion or pin. In addition to different flap devices, other opening mechanisms are also conceivable, (for example, the dust flaps could be pushed rearward or pivoted upward by a rotational movement).

The dust flaps 9*a,* 9*b* are preferably opened by direct contact with the protrusion or pin. If this is a shortcoming for lack of space or other reasons, an intermediate mechanism can be provided that permits indirect opening of the dust flap 9*a,* 9*b* by the protrusion or pin.

In another embodiment, the dust flaps 9*a,* 9*b* are loaded by a spring in the direction of opening and can be snapped onto the weapon housing for closing. It is sufficient for opening of the dust flaps to open the locking mechanism or loosen the dust flaps from it. The spring force ensures that the dust flaps open fully and do not hamper casing ejection. In a preferred embodiment, the dust flap 9*a,* 9*b* remains open after the first casing ejection so that the shooter must close it by hand. However, it is also conceivable to have the dust flap 9*a,* 9*b* reclose automatically after casing ejection. A corresponding closure mechanism could be operated by the forward movement of the bolt assembly (during, for example, reloading of a new cartridge).

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. For use in a firearm having a housing defining a first ejection opening and a second ejection opening, an apparatus comprising:

a first dust flap mounted adjacent the first ejection opening for movement between an opened position and a closed position;

a second dust flap mounted adjacent the second ejection opening for movement between an opened position and a closed position;

a bolt assembly adapted to be selectively mounted in a first assembly position and a second assembly position for longitudinal movement within the housing; and an ejection device coupled to the bolt assembly for ejecting cartridge casings through the first ejection opening when the bolt assembly is in the first assembly position and for ejecting cartridge casings through the second ejection opening when the bolt assembly is in the second assembly position, wherein when the bolt assembly is in the first assembly position, a longitudinal movement of the bolt assembly moves the first dust flap to the opened position and, when the bolt assembly is in the second assembly position, the longitudinal movement of the bolt assembly moves the second dust flap to the opened position.

2. An apparatus as defined in claim 1, wherein the bolt assembly includes a protrusion, wherein when the bolt assembly is in the first assembly position, the protrusion is positioned to strike the first dust flap during the longitudinal movement of the bolt assembly, and wherein, when the bolt assembly is in the second assembly position, the protrusion is positioned to strike the second dust flap during the longitudinal movement of the bolt assembly.

3. An apparatus as defined in claim 1, wherein each of the first and second dust flaps has an inwardly directed tab.

4. An apparatus as defined in claim 2, wherein the protrusion comprises a pin mounted on the bolt assembly.

5. An apparatus as defined in claim 4, wherein the bolt assembly defines a transverse hole which is dimensioned to receive the pin.

6. An apparatus as defined in claim 4, wherein the pin defines a retaining hole which is dimensioned to receive a firing pin.

7. An apparatus as defined in claim 2, wherein the bolt assembly comprises a bolt carrier and a bolt head, the bolt carrier defines a chamber, and the bolt head is dimensioned to be at least partially received within the chamber.

8. An apparatus as defined in claim 4, wherein the bolt assembly comprises a bolt head and a bolt carrier, and the bolt carrier defines at least two substantially arc-shaped, elongated holes which are dimensioned to receive the pin.

9. An apparatus as defined in claim 1, wherein the ejection openings are located opposite each other.

10. An apparatus as defined in claim 1, wherein the first and second dust flaps are mounted for outward movement from their respective ejection openings.

11. An apparatus as defined in claim 1, wherein the first and second dust flaps are respectively biased toward their opened positions, and the first and second dust flaps can be respectively locked in their closed positions.

12. An apparatus as defined in claim 1, wherein, when the first dust flap is in the opened position, the first dust flap permits substantially unhampered emergence of cartridge casings from the first ejection opening, and, when the first dust flap is in the closed position, the first dust flap closes the first ejection opening, and wherein, when the second dust flap is in the opened position, the second dust flap permits substantially unhampered emergence of cartridge casings from the second ejection opening, and, when the second dust flap is in the closed position, the second dust flap closes the second ejection opening.

13. For use in a firearm having a housing defining a first ejection opening and a second ejection opening, an apparatus comprising:

a first dust flap mounted adjacent the first ejection opening for movement between an opened position and a closed position;

a second dust flap mounted adjacent the second ejection opening for movement between an opened position and a closed position;

a bolt assembly adapted to be selectively mounted in a first assembly position and a second assembly position for longitudinal movement within the housing;

an ejection device coupled to bolt assembly for ejecting cartridge casings through the first ejection opening when the bolt assembly is in the first assembly position and for ejecting cartridge casings through the second ejection opening when the bolt assembly is in the second assembly position; and means for moving the first dust flap to the opened position when the bolt assembly moves longitudinally and the bolt assembly is in the first assembly position, and for moving the second dust flap to the opened position when the bolt assembly moves longitudinally and the bolt assembly is in the second assembly position.

14. For use in a firearm having a housing defining a first ejection opening and a second ejection opening, an apparatus comprising:

a first dust flap mounted adjacent the first ejection opening for movement between an opened position and a closed position;

a second dust flap mounted adjacent the second ejection opening for movement between an opened position and a closed position;

a bolt assembly adapted to be selectively mounted in a first assembly position and a second assembly position for longitudinal movement within the housing;

an ejection device coupled to bolt assembly for ejecting cartridge casings through the first ejection opening when the bolt assembly is in the first assembly position and for ejecting cartridge casings through the second ejection opening when the bolt assembly is in the second assembly position;

first means for moving the first dust flap to the opened position when the bolt assembly moves longitudinally and the bolt assembly is in the first assembly position; and second means for moving the second dust flap to the opened position when the bolt assembly moves longitudinally and the bolt assembly is in the second assembly position.

15. An apparatus as defined in claim 14 wherein the first means comprises a first pin and the second means comprises a second pin different from the first pin.

* * * * *